US005197790A

United States Patent [19]

Katz

[11] Patent Number: 5,197,790

[45] Date of Patent: Mar. 30, 1993

[54] CABINET HAVING AN ADJUSTABLE HINGE FOR MOUNTING A CABINET DOOR

[75] Inventor: Howard S. Katz, Riegelsville, Pa.

[73] Assignee: Robern, Inc., Bensalem, Pa.

[21] Appl. No.: 645,368

[22] Filed: Jan. 24, 1991

[51] Int. Cl.[5] ..... A47B 88/00

[52] U.S. Cl. ..... 312/329; 16/340; 16/339

[58] Field of Search ..... 312/328, 329, 245, 321.5, 312/326, 324; 16/225, 339, 273, 340, 338

[56] References Cited

U.S. PATENT DOCUMENTS

| | | | |
|---|---|---|---|
| 341,636 | 5/1886 | Breithut . | |
| 763,220 | 6/1904 | Totten . | |
| 1,620,701 | 3/1927 | Teich . | |
| 1,847,937 | 3/1932 | Fetters . | |
| 3,235,902 | 2/1966 | Meyer | 16/140 |
| 3,474,470 | 10/1969 | Watson | 4/240 |
| 3,603,559 | 9/1971 | Frantz | 16/340 |
| 3,837,042 | 9/1974 | White | 16/140 |
| 4,854,009 | 8/1989 | Brockhaus | 16/273 |

*Primary Examiner*—Kenneth J. Dorner
*Assistant Examiner*—Gerald A. Anderson
*Attorney, Agent, or Firm*—Panitch Schwarze Jacobs & Nadel

[57] ABSTRACT

A cabinet having a quiet, frictionally adjustable door hinge is disclosed. The cabinet door can be positioned anywhere between fully opened and fully closed positions. The cabinet comprises an adjustable hinge having an expandable member which contacts a bearing surface.

12 Claims, 2 Drawing Sheets

CABINET HAVING AN ADJUSTABLE HINGE FOR MOUNTING A CABINET DOOR

FIELD OF THE INVENTION

The present invention relates generally to cabinets and, more particularly, to a cabinet having a door mounted by an adjustable hinge.

BACKGROUND OF THE INVENTION

The bathroom cabinet industry generally uses metallic hinge assemblies for supporting the doors of the cabinets. These hinges are typically free swinging, i.e., the hinges are generally free of friction, such that the cabinet door is easily movable from the closed position to a fully opened position or at any other position. Unless the cabinet and door were perfectly mounted, i.e., with the door perfectly level, the force of gravity would cause the door to tend to either open or close (depending upon the balance of the door). Thus, prior art cabinets often required a catch or latch for holding the door in the closed position and/or some other type of movable device to hold the door in an open or partially open position. Moreover, all-metallic hinges typically have noise problems.

The present invention overcomes the limitations of the prior art by providing a hinge system comprised of a non-metallic hinge pin which is expandable to provide a controlled amount of hinge friction for holding a cabinet door in any desired position of its swing, i.e., wherever a user positions the door, without the use of any catches or other additional components. Additionally, the noise problems associated with allmetallic hinges are overcome. The present invention is also useful in reducing instances of slamming of a cabinet door, thereby decreasing the likelihood of breakage of a door mirror.

SUMMARY OF THE INVENTION

Briefly stated, the present invention comprises a cabinet having an adjustable hinge for mounting a cabinet door. The cabinet comprises a cabinet body having an internal storage area for receiving items to be stored and an opening for accessing the storage area. The cabinet additionally comprises a cabinet door pivotally mounted to the cabinet body and adjustable hinge means interconnected between the cabinet door and the cabinet body supporting the cabinet door. The hinge means allows the cabinet door to pivot with respect to the cabinet body between a first position wherein the cabinet door is positioned proximate the cabinet opening for closing the opening and a second position wherein the cabinet door is positioned away from the opening. The hinge means also allow for adjusting the force necessary to move the cabinet door between the first and second positions.

BRIEF DESCRIPTION OF THE DRAWINGS

The foregoing summary, as well as the detailed description of the preferred embodiment, will be better understood when read in conjunction with the appended drawings. For the purpose of illustrating the invention, there is shown in the drawings an embodiment which is presently preferred, it being understood however, that the invention is not limited to the specific methods and instrumentalities disclosed. In the drawings.

DETAILED DESCRIPTION OF THE PREFERRED EMBODIMENT

Figure 1:
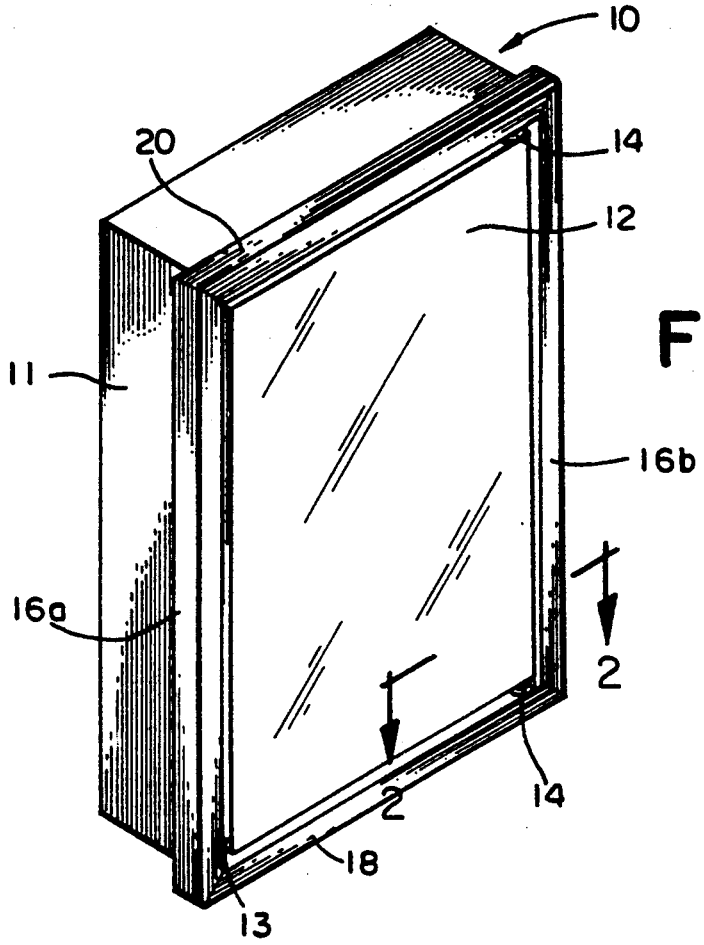
FIG. 1 is a top perspective view of a cabinet having an adjustable hinge for mounting a cabinet door in accordance with the present invention.

Referring to the drawings, Wherein like numerals indicate like elements throughout, there is shown in FIG. I a cabinet 10 having a cabinet body 11 an internal storage area 22 (not shown in FIG. 1) and a cabinet door 13. In the presently preferred embodiment, the cabinet door 13 is comprised of a mirror 12. Adjustable hinge means 14 pivotally mount the cabinet door 13 to the cabinet body 11.

It is understood by those skilled in the art, that the present invention is not limited to any specific type, shape or size cabinet and that the cabinet 10 can be surface or recess mounted. That is, the cabinet 10 is of the type which is known to those skilled in the art, and therefore, further description thereof is omitted for convenience only, and is not limiting. However, in the present embodiment it is preferred that the present invention be used in conjunction with a bath-type cabinet wherein the cabinet door 13 comprises a mirror 12.

The cabinet body 11 of the cabinet 10 comprises right and left side channel members, **16*a* and 16*b*, respectively, a top channel member 20, and a bottom channel member 18. In the presently preferred embodiment, the adjustable hinge means 14 pivotally mounts the cabinet door 13 to both the top and bottom channel members 18 and 20**.

It is understood by those skilled in the art that the present invention is not limited to a cabinet unit having a door with two hinges. It is also understood by those skilled in the art that only one hinge can be used to pivotally mount the cabinet door 13 to the cabinet body 11. Similarly, the cabinet body 11 need not be comprised of four channel members. Only one channel member, capable of connection with the adjustable hinge means 14, need be present.

Figure 2:
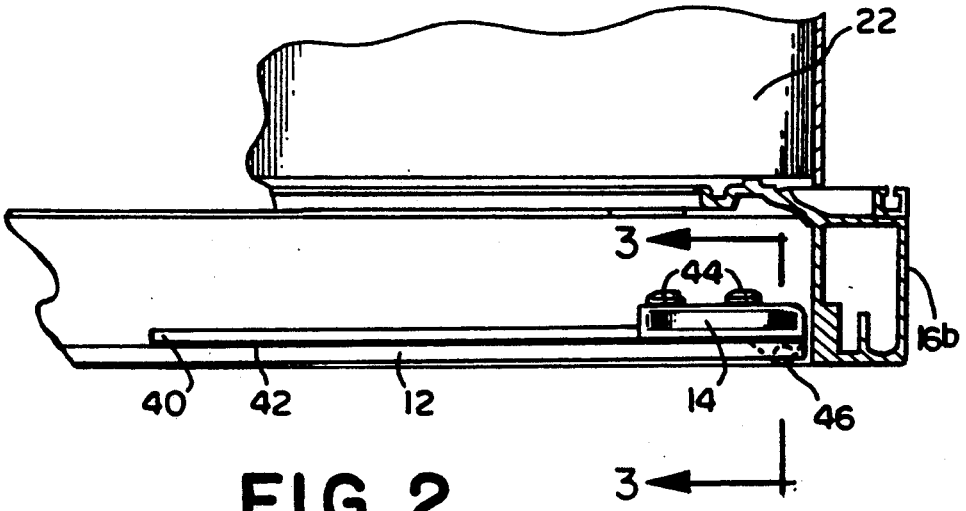
FIG. 2 is an enlarged cross-sectional view of the cabinet of FIG. 1 taken along line 2—2 of FIG. 1.

Referring now to FIG. 2, the adjustable hinge means 14 comprises a hinge member including a generally cylindrical pin 46 and securing means for attachment of the hinge member 46 to the cabinet door 13. In the presently preferred embodiment, the adjustable hinge means 14 is secured to a door rib 40 by door rib mounting screws 44. The mirror 12 is mounted on the door rib 40 by a double-sided adhesive pad 42. Of course, the mirror 12 may be mounted in any other suitable manner.

Figure 3:
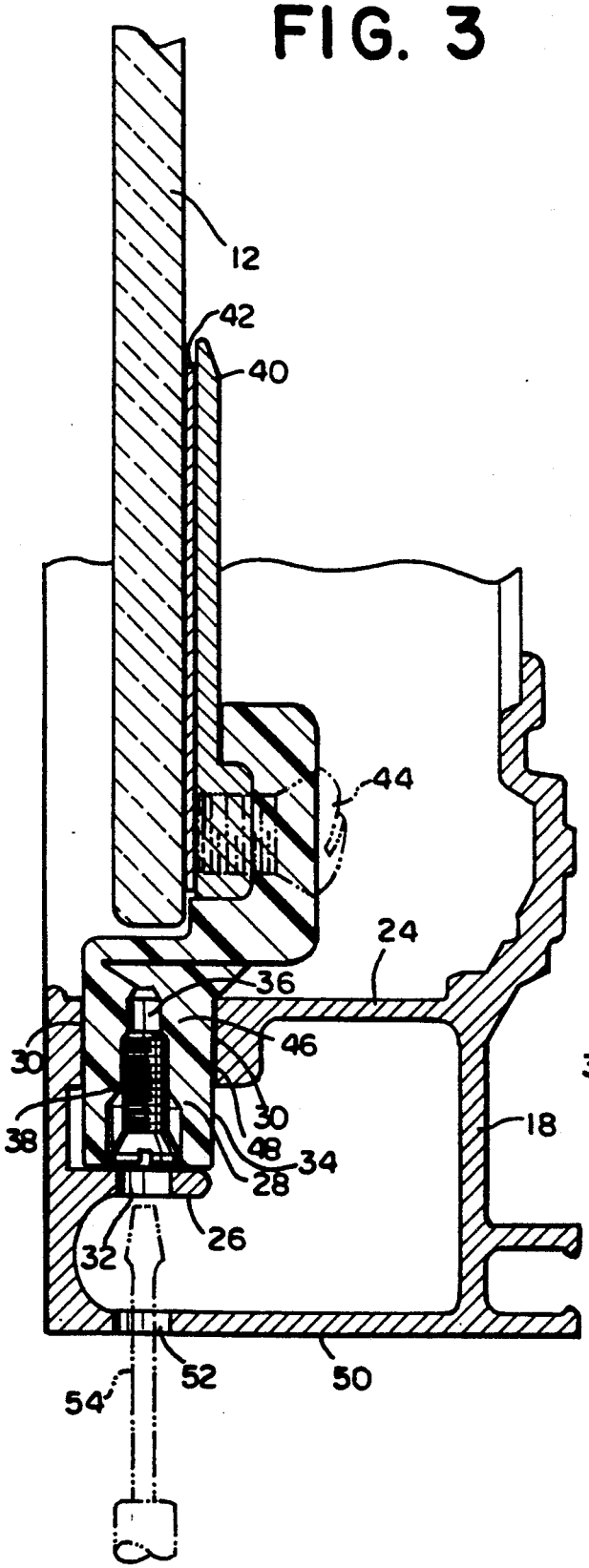
FIG. 3 is a greatly enlarged cross-sectional view view of a portion of the cabinet of FIG. taken along line 3—3 of FIG. 2 showing the adjustable hinge means.
Figure 4:
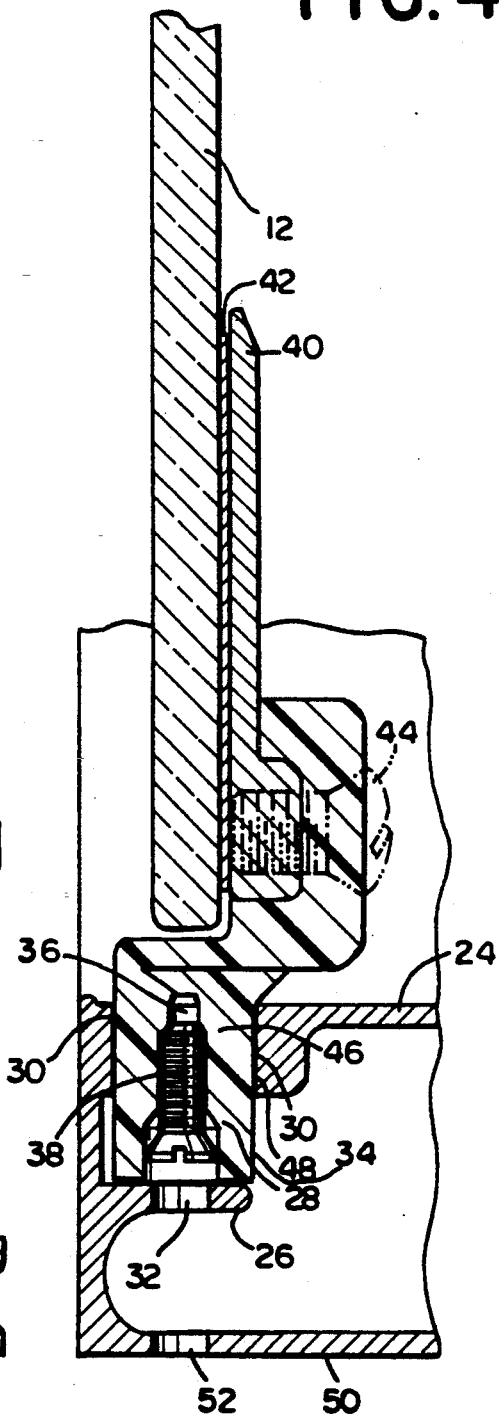
FIG. 4 view similar to FIG. 3.

Now referring to FIGS. 3 and 4, the adjustable hinge means 14 further comprises a channel member, such as the bottom channel member 18 capable of accepting the hinge pin 46. In the presently preferred embodiment, the bottom channel member 18 comprises a first wall 24, a second wall 26, and a third wall 50. The walls 24, 26 and 50 are generally parallel to each other and, in the illustrated embodiment, are generally horizontal. The channel members **16*a*, 16*b*, 18 and 20** are preferably fabricated out of a strong, lightweight metallic material such as aluminum. However, it is understood by those skilled in the art that the channel members can be constructed of other materials, such as a polymeric material or wood.

The first wall 24 includes a generally circular pivot aperture 48 for receiving the hinge pin 46. The hinge pin 46, fabricated out of a strong, non-metallic material such as nylon, comprises a cylindrical expandable member 28 having an outer radial surface 34 which contacts a bearing surface 30 of the pivot aperture 48. The second wall 26 and third wall 50 have access apertures 32 and 52, respectively, for accessing the expandable member 28. The second wall 26 also functions as a support member for supporting the hinge pin 46 and the weight of the cabinet door 13.

Disposed centrally within a bore 36 extending into the expandable member 28 along a longitudinal axis thereof is a cylindrical externally threaded member, such as a screw 38, which serves to expand and contract the expandable member 28. The screw 38 can be adjusted inwardly with a screw driver 54 through the access apertures 32 and 52 such that a desired amount of hinge friction is obtained between the bearing surface 30 and the expandable member radial outer surface 34.

The screw 38 is turned inwardly until the hinge friction is sufficient to overcome the force of gravity and to effectively hold the cabinet door 13, either in the closed position (without the use of a magnetic or any other type of catch) or at any other location along its swing. This configuration enables a person to use a mirrored door at a particular angle in order to obtain three-way viewing; one merely opens the door to the desired angle and the door stays at that particular angle because the friction between the bearing surface 30 and the expandable member radial outer surface is sufficient to overcome the force of gravity and hold the door in the precise location where it is positioned.

A hinge construction of this type allows the same hinge to be used with a plurality of doors having a different weights and configurations without regard to the manner in which the cabinet is mounted (i.e. even if the cabinet or door are not perfectly level), since, once the cabinet is mounted and in place, its hinge pin is individually adjusted to provide the proper amount of hinge friction. Additionally, as a door opens and closes and the amount of friction on the hinge pin causes the hinge pin or hinge to wear, the expandable member 28 may again be adjusted in order to maintain the correct amount of friction for holding the door at a desired position. Moreover, the bearing surface of the hinge pin 46 makes little or no noise as it turns with respect to the bearing surface 30.

From the foregoing description, it can be seen that the present invention comprises a cabinet having an adjustable hinge for mounting a cabinet door. The construction of the hinge enables noise-free operation of the cabinet door and enables the user to position the cabinet door at any angle desired. It also reduces the likelihood that a mirrored door will be broken by decreasing the likelihood that the door will be slammed. It will be appreciated by those skilled in the art, that changes could be made to the embodiment described above without departing from the broad inventive concepts thereof. It is understood, therefore, that this invention is not limited to the particular embodiment disclosed, but is intended to cover all modifications which are within the scope and spirit of the invention as defined by the appended claims.

I claim:

1. A cabinet having an adjustable hinge for mounting a cabinet door, the cabinet comprising:

a cabinet body having an internal storage area for receiving items to be stored and an opening for accessing said storage area;

a cabinet door pivotally mounted to the cabinet body;

adjustable hinge means interconnected between the cabinet door and the cabinet body for supporting the cabinet door and allowing the cabinet door to pivot with respect to the cabinet body between a first position such that the cabinet door is positioned proximate the cabinet opening for closing the opening and a second position such that the cabinet door is positioned away from the opening and for adjustably establishing the force necessary to move said cabinet door between said first and second positions, wherein said adjustable hinge means provides a controlled amount of friction for holding said cabinet door in a desired position, the hinge means comprises:

a first channel member mounted on said cabinet body, said first channel member including a first wall, a second wall and a third wall, all of said walls extending generally parallel with respect to each other and being spaced apart, said first wall including a generally circular pivot aperture having a bearing surface;

a generally cylindrical expandable member extending from said cabinet door and having an expandable radially outer surface, said expandable member being positioned within said pivot aperture and being complimentarily sized to rotate with respect thereto, said expandable member being supported by the second wall of said first channel member, said second wall and third wall of said first channel member each including an access aperture, an expanding means accessible through said access aperture for expanding said expandable outer surface radially outwardly and into engagement with said bearing surface to inhibit said expandable member and cabinet door from moving with respect to said first channel member and cabinet body whereby when said expandable outer surface is expanded into engagement with said bearing surface, force due to gravity is insufficient to move said cabinet door with respect to said cabinet body.

2. The cabinet of claim 1 wherein said expanding means is accessible through said access apertures in said second and third walls.

3. The cabinet of claim 1 wherein said expanding means comprises:

a bore extending into said expandable member along a longitudinal axis thereof, said bore having a nominal diameter; and a generally cylindrical threaded member wherein the cylindrical portion has a nominal diameter for being threadably disposed within said bore, said nominal diameter of said threaded member being approximately equal to the nominal diameter of said bore, said threaded member being positioned within said bore such that said expandable outer surface is expanded outwardly into engagement with said bearing surface whereby movement of said threaded member in and out of said threaded bore results in expansion and contraction, respectively, of said expandable outer surface.

4. The cabinet of claim 3 wherein said threaded member is accessible through said access apertures in said second and third walls.

5. The cabinet of claim 3 wherein said expandable member is nylon.

6. The cabinet of claim 3 wherein said threaded member is a screw.

7. An adjustable hinge for pivotally mounting a cabinet door to a cabinet body, the adjustable hinge comprising:

a first channel member for being mounted on said cabinet body, said first channel member including a first wall, a second wall and a third wall, all of said walls extending generally parallel with respect to each other and being spaced apart, said first wall including a generally circular pivot aperture having a bearing surface; and a generally cylindrical expandable member extending from said cabinet door and having an expandable radially outer surface, said expandable member being positioned within said pivot aperture and complimentarily sized to rotate with respect thereto, said expandable member being supported by the second wall of said first channel member, said second wall and third wall of said first channel member each including an access aperture, an expanding means accessible through said access aperture for expanding said expandable outer surface radially outwardly and into engagement with said bearing surface to inhibit said expandable member from moving with respect to said channel member whereby when said expandable outer surface is expanded into engagement with said bearing surface force due to gravity is insufficient to move said expandable member with respect to said channel member.

8. The hinge as recited in claim 7 wherein said expanding means is accessible through said apertures in said second and third walls.

9. The hinge as recited in claim 7 wherein said expanding means comprises:

a bore extending into said expandable member along a longitudinal axis thereof, said bore having a nominal diameter; and a generally cylindrical threaded member wherein the cylindrical portion has a nominal diameter for being threadably disposed within said bore, said nominal diameter of said member being approximately equal to the nominal diameter of said bore, said threaded member being positioned within said bore wherein said expandable outer surface is expanded outwardly into engagement with said bearing surface whereby movement of said threaded member in and out of said threaded bore results in expansion and contraction, respectively, of said expandable outer surface.

10. The cabinet of claim 9 wherein said threaded member is accessible through said access aperture in said second wall.

11. The cabinet of claim 9 wherein said expandable member is nylon.

12. The cabinet of claim 9 wherein said threaded member is a screw.

* * * * *